US011814917B2

(12) United States Patent
Kellner

(10) Patent No.: US 11,814,917 B2
(45) Date of Patent: Nov. 14, 2023

(54) SURFACE PULSE VALVE FOR INDUCING VIBRATION IN DOWNHOLE TUBULARS

(71) Applicant: INNOVEX DOWNHOLE SOLUTIONS, INC., Houston, TX (US)

(72) Inventor: Justin Kellner, Adkins, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 191 days.

(21) Appl. No.: 17/144,593

(22) Filed: Jan. 8, 2021

(65) Prior Publication Data

US 2021/0215011 A1 Jul. 15, 2021

Related U.S. Application Data

(60) Provisional application No. 62/959,301, filed on Jan. 10, 2020.

(51) Int. Cl.
*E21B 28/00* (2006.01)
*E21B 34/02* (2006.01)

(52) U.S. Cl.
CPC ..... *E21B 28/00* (2013.01); *E21B 34/02* (2013.01); *E21B 2200/06* (2020.05)

(58) Field of Classification Search
CPC ..... E21B 2200/06; E21B 28/00; E21B 34/02
See application file for complete search history.

(56) References Cited

U.S. PATENT DOCUMENTS

| | | | | |
|---|---|---|---|---|
| 9,416,620 | B2 * | 8/2016 | Hannegan | E21B 28/00 |
| 10,829,995 | B2 * | 11/2020 | Tonti | E21B 34/10 |
| 2013/0048300 | A1 * | 2/2013 | MacDonald | E21B 47/18 166/373 |
| 2014/0124693 | A1 * | 5/2014 | Gopalan | F16K 27/045 251/359 |
| 2017/0051610 | A1 * | 2/2017 | Sitka | E21B 47/16 |
| 2019/0010762 | A1 * | 1/2019 | Rossing | E21B 28/00 |
| 2019/0211673 | A1 * | 7/2019 | Gopalan | E21B 34/16 |
| 2021/0215011 | A1 * | 7/2021 | Kellner | E21B 28/00 |
| 2021/0340864 | A1 * | 11/2021 | Zhan | E21B 21/12 |

FOREIGN PATENT DOCUMENTS

WO WO-2022087721 A1 * 5/2022

* cited by examiner

*Primary Examiner* — Daniel P Stephenson
(74) *Attorney, Agent, or Firm* — MH2 TECHNOLOGY LAW GROUP, LLP

(57) ABSTRACT

An apparatus and method for generating vibration in a downhole tubular, in which the apparatus includes a pulse valve that is configured to open and close intermittently, so as to intermittently vary pressure of a fluid that flows into the downhole tubular and thereby generate vibration in the downhole tubular, and a driver coupled to the pulse valve and configured to open and close the pulse valve. The driver is powered by a source of energy that is not in fluid communication with the downhole tubular.

20 Claims, 6 Drawing Sheets

SURFACE PULSE VALVE FOR INDUCING VIBRATION IN DOWNHOLE TUBULARS

CROSS-REFERENCE TO RELATED APPLICATIONS

This application claims priority to U.S. Provisional Patent Application having Ser. No. 62/959,301, which was filed on Jan. 10, 2020 and is incorporated herein by reference in its entirety.

BACKGROUND

In oil and gas wells, various types of tubulars are advanced into the well to support various operations. One type of tubular is a coiled tubing, which is often used as part of intervention operations. The coiled tubing may be pushed into the well; however, the mechanical properties of the coiled tubing may limit the depth to which the coiled tubing during can reach before friction and buckling of the tubing prevent further deployment.

Vibration tools may be used to increase the depth to which the coiled tubing is able to extend. A vibration tool typically generates an intermittent transverse force on a section of the tubing, thereby reducing friction between the coiled tubing and the surrounding tubular by momentarily separating the coiled tubing from contact with the surrounding tubular. For instance, in a horizontal section of the well, the vibration tool may cause a section of the coiled tubing to momentarily lift off of the surrounding tubular. This "bouncing" action may reduce overall friction forces, allowing the coiled tubing to be advanced.

Vibration tools are generally deployed downhole along with the coiled tubing. However, control of the vibration tools may become challenging because vibration tools typically rely on fluid flow through the coiled tubing to cause the vibration. Thus, the vibration may be controlled only by fluid flow rate at the surface. Further, other aspects of the well may continue to require high fluid flow rates (e.g., sweeps or debris flowback) when vibration is unnecessary; however, the vibration generally cannot be stopped when fluid is flowing, and thus unnecessary vibration is generated, which can wear on the downhole components.

SUMMARY

Embodiments of the disclosure may provide an apparatus for generating vibration in a downhole tubular. The apparatus includes a pulse valve that is configured to open and close intermittently, so as to intermittently vary pressure of a fluid that flows into the downhole tubular and thereby generate vibration in the downhole tubular, and a driver coupled to the pulse valve and configured to open and close the pulse valve. The driver is powered by a source of energy that is not in fluid communication with the downhole tubular.

Embodiments of the disclosure may also provide a method including pumping a fluid into a downhole tubular using a pump, and intermittently opening and closing a pulse valve positioned downstream from the pump and upstream from the downhole tubular using a driver. Intermittently opening and closing the pulse valve causes intermittent pressure variations of the fluid in the downhole tubular, so as to vibrate the downhole tubular.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1:
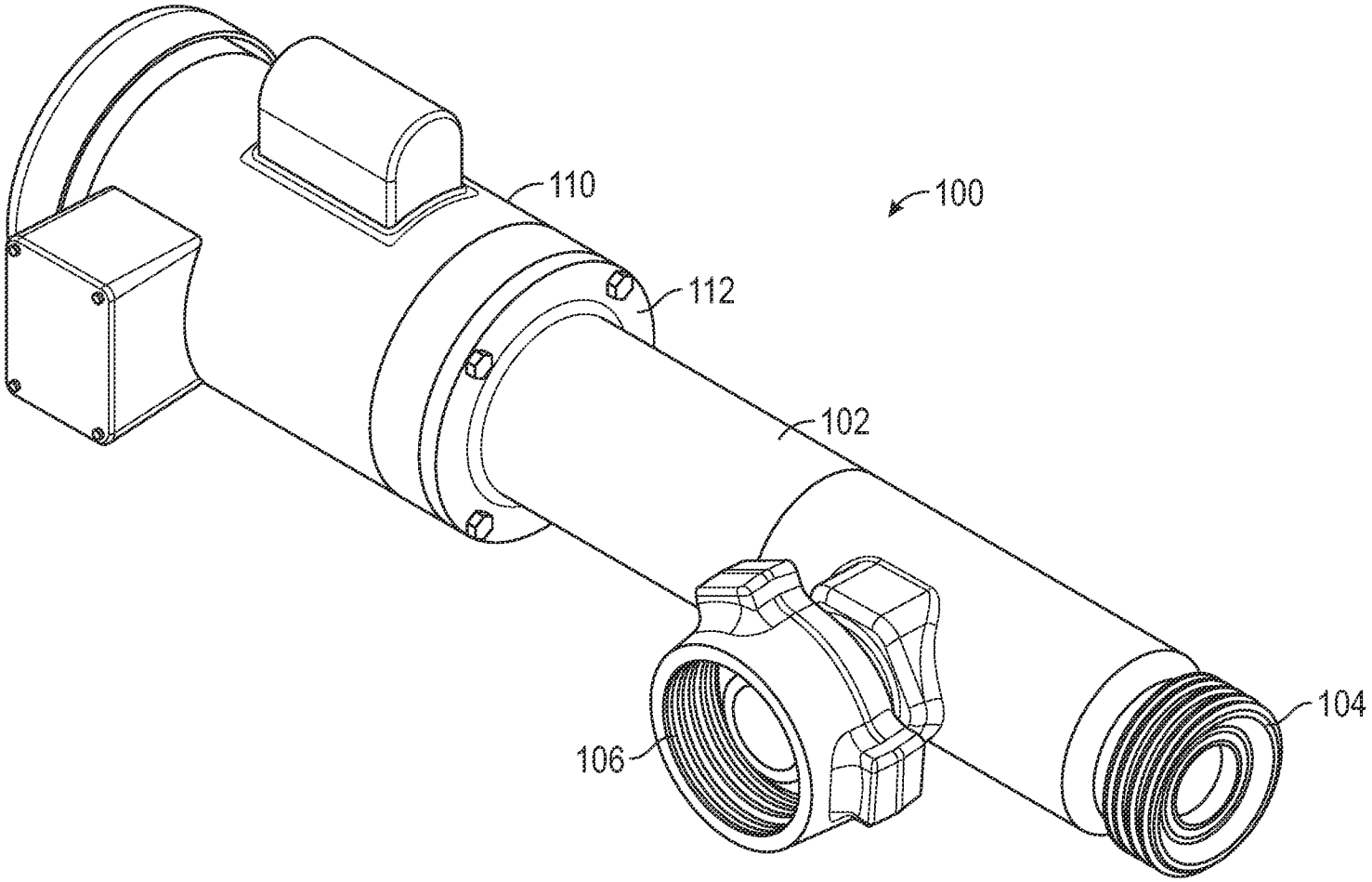
FIG. 1 illustrates a raised perspective view of a pulse valve for inducing vibration in a downhole tubular, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a perspective view of a pulse valve 100, according to an embodiment. The pulse valve 100 may include a housing 102 having an inlet 104 and an outlet 106 therein. The housing 102 may be generally cylindrical, defining a longitudinal axis about which the housing 102 is generally defined. In an embodiment, the inlet 104 may be oriented along the longitudinal axis of the housing 102 (i.e., "axially-oriented"), and the outlet 106 may be oriented perpendicular thereto, e.g., radially with respect the housing 102. The inlet 104 and outlet 106 may include threads for coupling to pipes, etc. As shown, the inlet 104 may be a male fitting (externally-threaded), and the outlet may be a female fitting (internally-threaded), but in other embodiments, either or both of the inlet 104 and/or the outlet 106 may be either male or female, or may include other types of fittings for making connections with external conduits.

The pulse valve 100 may also include a driver 110. The driver 110 may be coupled to the housing 102, e.g., via fastening to an outwardly-extending flange 112. The driver 110 may be coupled to an external source of power, which may cause a shaft of the driver 110 to rotate. As the shaft of the driver 110 rotates, the valve 100 may be caused to intermittently open and close, thereby creating pressure pulses in a fluid that is fed to a downhole tool. When the valve 100 is open, the fluid is permitted to flow from the inlet 104 to the outlet 106, and when the valve 100 is closed, the fluid is blocked from flowing from the inlet 104 to the outlet 106. The driver 110 may be capable of operating at variable speeds (e.g., using a variable frequency drive), thereby allowing for adjustments to the frequency at which the valve 100 is open and closed. Further, the valve 100 may be configured to be located at the top surface (e.g., ground-level), rather than in a well, which may facilitate tuning the operation of the valve 100, e.g., by adjusting the driver 110 and/or internal components of the valve 100 itself. In other embodiments, the valve 100 may be positioned in a well.

Figure 2:
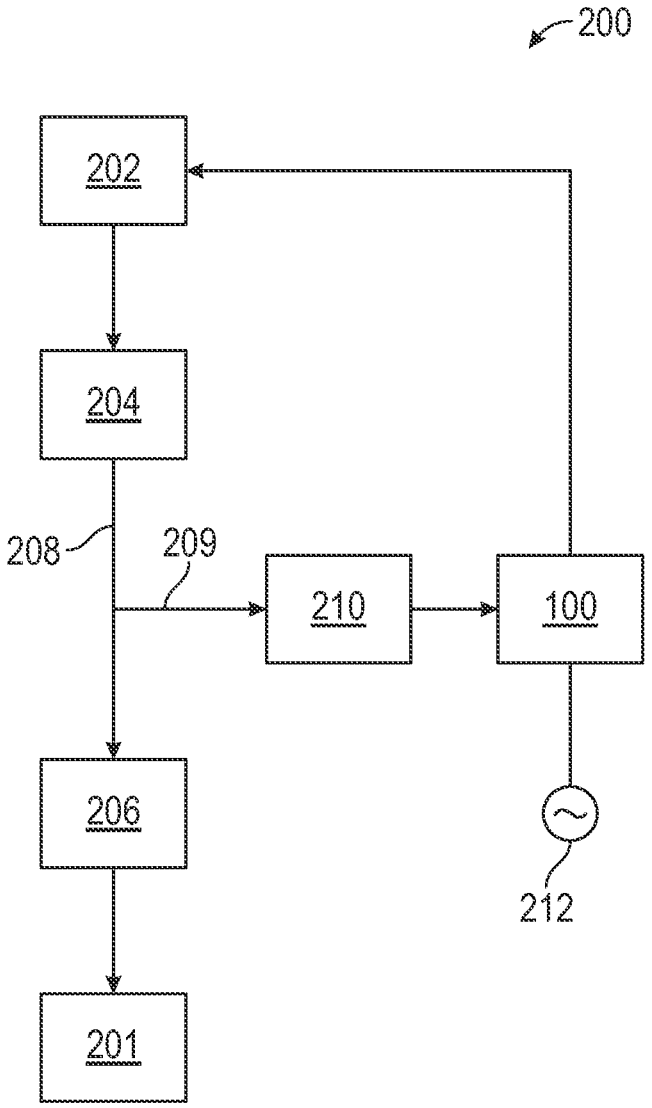
FIG. 2 illustrates a schematic view of a fluid injection system for a well, according to an embodiment.

FIG. 2 illustrates a schematic view of a fluid injection system 200 for a well 201, according to an embodiment. The fluid injection system 200 generally includes a tank 202, a pump 204 that receives fluid from the tank 202 and pressurizes the fluid, and a downhole tubular (e.g., coiled tubing) 206 that is deployed or deployable into the well 201. The pump 204 may be configured to generate a generally constant flow of fluid at its outlet. Fluid exiting the downhole tubular 206 may proceed into the well 201, as indicated, and may be circulated back through an annulus or another flowpath to the surface, as desired.

A line 208 extends between the outlet of the pump 204 and the downhole tubular 206, allowing the fluid pressurized by the pump 204 to proceed into the downhole tubular 206. A pulse line 209 may be connected to the line 208, and a shutoff valve 210 may be coupled to the pulse line 209. In an embodiment, the shutoff valve 210 may be a plug valve, gate valve, etc. When the shutoff valve 210 is closed, fluid from the pump 204 may still proceed through the line 208 to the downhole tubular 206. The pulse valve 100, e.g., the inlet 104 (FIG. 1) thereof, may be coupled to the shutoff valve 210, such that the shutoff valve 210 controls fluid communication from the line 208 to the pulse valve 100. The pulse valve 100, e.g., the outlet 106 (FIG. 1) thereof, may also be coupled to the tank 202.

Accordingly, when the shutoff valve 210 and the pulse valve 100 are open, at least some of the fluid in the line 208 may flow from the line 208 and back into the tank 202 via the pulse line 209. This may cause a momentary drop in pressure in the line 208, until the pulse valve 100 is closed, e.g., via operation of the driver 110, even though pressure and/or flow rate of fluid at the pump 204 may remain generally constant. In some embodiments, two or more pulse valves 100 may be employed, either in parallel or in series, and may be independently controlled or controlled in combination. A parallel configuration of two or more valves 100 may be employed to tune volume of fluid vented. For example, each valve 100 may provide a flowpath area that may allow passage of a certain amount of fluid during the time that the valves 100 are open, and thus increasing the number of valves 100 may increase the amount of fluid that is vented. Moreover, whether in parallel or in series, multiple valves 100 have different timing for when they are opened and closed may be added for additional tuning.

In addition, as shown also in FIG. 2, an external source of power 212 is coupled to the pulse valve 100, so as to power the driver 110 (FIG. 1). The external source of power 212 may, in some embodiments, be an electric power source, such as, for example, a generator or a public utility power grid. Accordingly, the driver 110 may be an electric motor. In other embodiments, the driver 110 may be an engine that receives gasoline or another type of fuel as its external power source. In at least some embodiments, the power source 212 may be independent from (e.g., not in direct communication with) fluid that flows through the inlet 104 and outlet 106.

Figure 3:
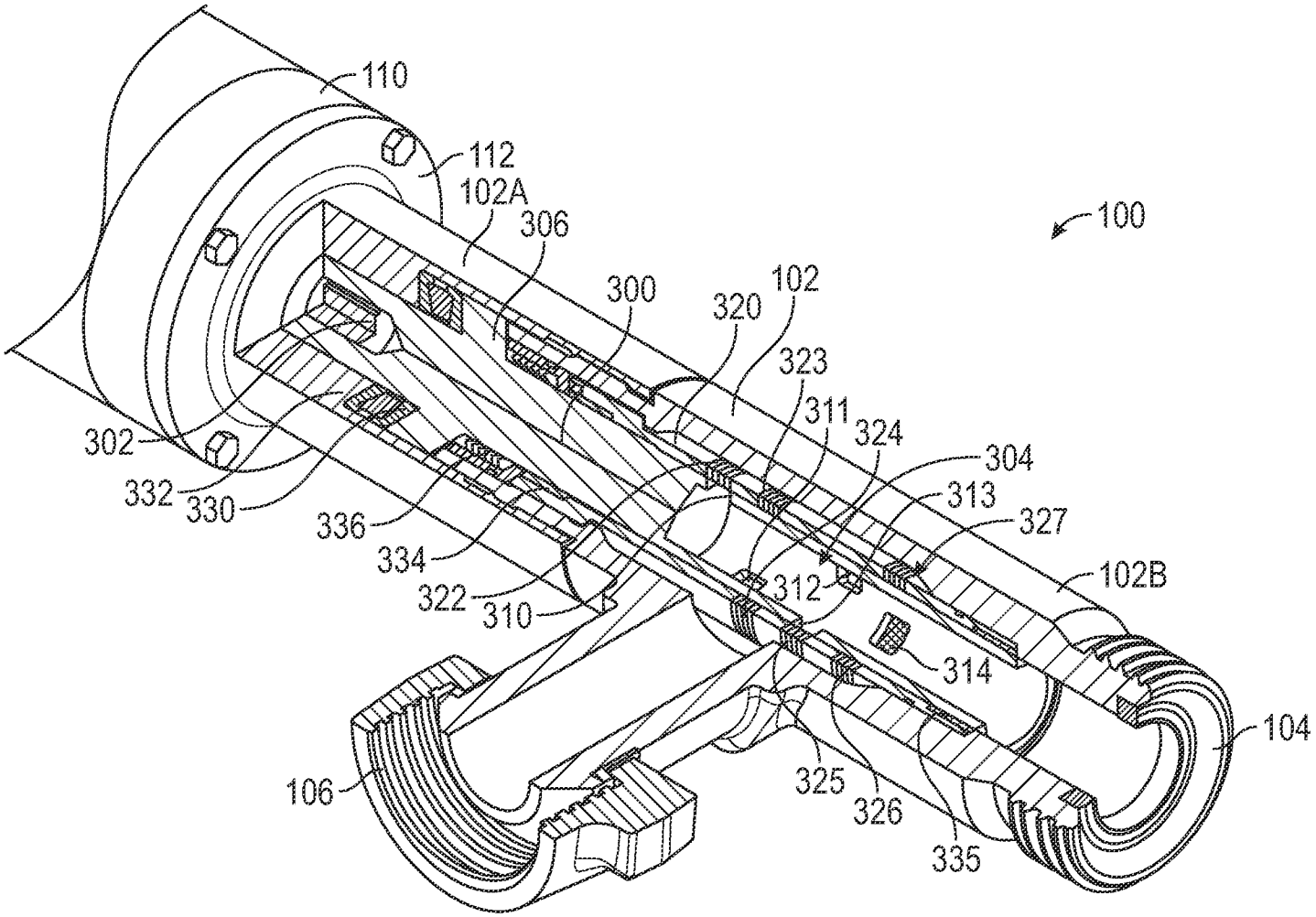
FIG. 3 illustrates a sectional view of the pulse valve, according to an embodiment.

FIG. 3 illustrates a sectional view of the pulse valve 100, according to an embodiment. As discussed above, the pulse valve 100 includes the housing 102, which defines the inlet 104 and the outlet 106, as well as the flange 112 that connects the housing 102 to the driver 110. Additionally, housing 102 may be generally hollow, and may be made from two or more cylindrical sections 102A, 102B, which may be threaded together.

Further, the valve 100 includes a valve shaft 300. The valve shaft 300 may be coupled to the driver 110. In particular, the driver 110 may include a drive shaft 302, which may be threaded into connection with the valve shaft 300 or coupled via a keyed connection, as shown. In other embodiments, any suitable torque-transmitting connection between the drive shaft 302 and the valve shaft 300 may be provided.

At least a portion 304 of the valve shaft 300 may be hollow and may be in fluid communication with the inlet 104. In some embodiments, the valve shaft 300 may be formed from a single piece, but in other embodiments, may be fabricated by connecting a sleeve-shaped member to a solid shaft, e.g., with the solid shaft being connected to the drive shaft 302. In still other embodiments, the valve shaft 300 may not have a solid section, but may be entirely hollow. The valve shaft 300 may further include a shoulder 306, which may extend radially outward from a remainder of the valve shaft 300. The valve shaft 300 may define one or more first openings (five shown: 310, 311, 312, 313, and 314) extending radially therethrough. The first openings 310-314 may be same shape or different shapes, e.g., generally rectangular slots that may have different lengths.

The valve 100 may also include a valve sleeve 320, which may be positioned around at least a portion of the valve shaft 300, e.g., around at least a portion of the hollow portion 304 thereof. The valve shaft 300 may be rotatable relative to the valve sleeve 320. In some embodiments, the valve shaft 300 may be rotatable relative to the housing 102, while the valve sleeve 320 may be held stationary relative to the housing 102. In other embodiments, the valve sleeve 320 may be rotatable relative to the housing 102 in addition to or instead of the valve shaft 300 being rotatable relative to the housing 102. Any such configuration that allows for relative rotation between the valve shaft 300 and the valve sleeve 320 is within the scope of the description of the valve shaft 300 as being rotatable relative to the valve sleeve 320.

The valve sleeve 320 may further include one or more second openings (five shown: 322, 323, 324, 325, and 326). The second openings 322-326 may extend radially through the valve sleeve 320. Further, the second openings 322-326 may each be formed as a multiplicity of holes that are formed proximal to one another. This may increase a strength of the sleeve 320, in comparison to a larger, single opening, e.g., a slot. In other embodiments, the second openings 322-326 may each be formed as slots, e.g., as a single opening.

The second openings 322-326 may be configured to intermittently align with the first openings 310-314 of the valve shaft 300, depending on the angular position of the valve shaft 300 with respect to the valve sleeve 320. When one or more of the second openings 322-326 align with corresponding first openings 310-314, fluid flow from the inlet 104 to the outlet 106 is permitted. In particular, fluid may flow into the valve shaft 300 through the inlet 104, then through the valve shaft 300 and the valve sleeve 320 via the aligned openings 310-314, 322-326. An annulus 327 may be defined between a portion of the valve sleeve 320 and the housing 102, and may receive the fluid therein from the openings 310-314, 322-326. The fluid in the annulus 327 may then flow radially outward through the outlet 106. In contrast, when the second openings 322-326 are not aligned with the first openings 310-314, the valve sleeve 300 blocks fluid flow from the inlet 104 from reaching the outlet 106.

The valve 100 may include several components that support rotation of the valve shaft 300 relative to the valve sleeve 320, and, in particular, in this embodiment, the rotation of the valve shaft 300 relative to the housing 102. For example, the valve 100 may include a thrust bearing 330 that is axially between the shoulder 306 and an opposing shoulder 332 of the housing 102. The valve 100 may further include one or more radial bearings (two are shown: 334, 335), which may journal the valve shaft 300 within the valve sleeve 320. In other embodiments, the radial bearings 334, 335 may support the valve shaft 300 directly from the housing 102. The valve 100 may also include a shaft seal 336, which may prevent fluid from exiting the flowpath between the inlet 104 and the outlet 106.

Figure 4:
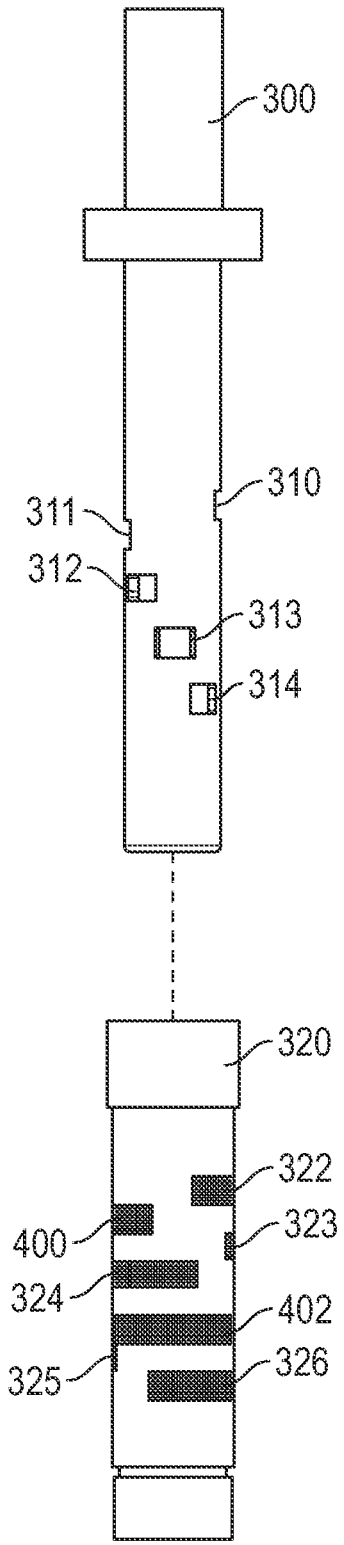
FIG. 4 illustrates an exploded, side view of a valve shaft and a valve sleeve of the pulse valve, according to an embodiment

FIG. 4 illustrates an exploded, side view of the valve shaft 300 and the valve sleeve 320, according to an embodiment. As noted above, the valve shaft 300 may be received into the valve sleeve 320, such that the valve sleeve 320 is positioned around the valve shaft 300. As shown, the first openings 310-314 in the shaft 300 may be formed through the shaft 300 and may be axially offset from one another. In addition, the first openings 310-314 may be angularly-offset from one another, around the circumference of the shaft 300. Likewise, the second openings 322-326 may be axially-offset from one another and angularly offset around the circumference of the valve sleeve 320.

Accordingly, as the valve shaft 300 rotates relative to the valve sleeve 320, zero, one, two, or more (up to all) of the first openings 310-314 may be aligned with corresponding second openings 322-326, thereby opening the valve 100, depending on the angular orientation of the valve shaft 300 relative to the valve sleeve 320. Thus, it will be appreciated that there may be more than one open position for the valve 100, as the flowpath area through the valve 100 may vary depending on the number of first and second openings 310-314, 322-326 that are aligned. Furthermore, there may be two or more patterns of openings in the valve sleeve 320, e.g., separated at an angular distance (e.g., 180 degrees) from one another. Thus, in this view, opening 400 is additional visible, and may be part of the second set of openings in the valve sleeve 320.

Additionally, the duration of time "full open" (e.g., all shaft openings 310-314 aligned with a corresponding one of the sleeve openings 322-326) can be modified by the circumferential coverage of the hole pattern. The farther around the circumference the pattern covers the longer the valve will be fully open to vent pressure. As shown the valve may be be fully open approximately one fourth of the rotation or 25% of the time.

Figure 5:
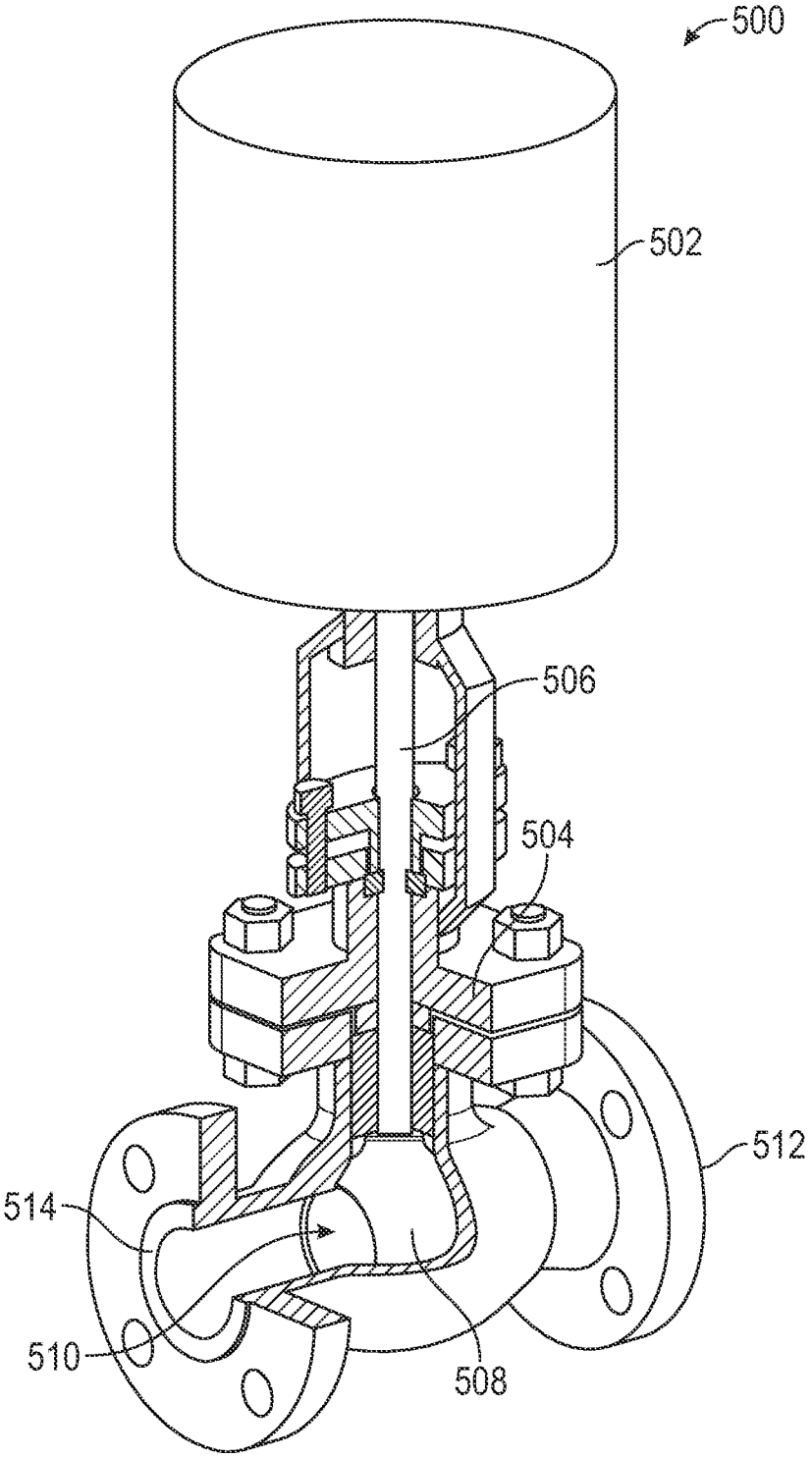
FIG. 5 illustrates a sectional view of another pulse valve, according to an embodiment.

FIG. 5 illustrates a sectional view of another pulse valve 500, according to an embodiment. Like the pulse valve 100, the pulse valve 500 may include a driver 502 that is coupled to valve housing 504. A valve shaft 506 may extend through at least a portion of the housing 504, and may be connected to the driver 502, such that operation of the driver 502 causes the driver 502 to rotate the valve shaft 506.

Further, a valve element 508 may be coupled to the valve shaft 506, so as to rotate therewith relative to the housing 504. In an embodiment, the valve element 508 may be a ball, but may, in other embodiments, be any suitable shape. The valve element 508 may define a through-bore 510 extending therethrough. The bore 510 may be cylindrical, or may be elongated, e.g., as a slot.

The valve housing 504 may have an inlet 512 and an outlet 514. The inlet 512 and the outlet 514 may be oriented parallel to one another and may be on opposite sides of the valve element 508. Accordingly, when the valve element 508 is rotated such that the through-bore 510 is aligned between the inlet 512 and the outlet 514, the through-bore 510 may allow fluid communication therebetween, thereby opening the valve 500. When the valve element 508 is rotated such that the through-bore 510 is not aligned between the inlet 512 and the outlet 514, the valve element 508 blocks fluid communication between the inlet 512 and the outlet 514, thereby closing the valve 500. Thus, operation of the pulse valve 500 may be similar to that of the pulse valve 100 and may be integrated into the system 200 in addition to or in lieu of the pulse valve 100. In some embodiments, the pulse valve 500 may also include a stationary valve sleeve, with openings therein, similar to the valve sleeve 320 discussed above.

Figure 6:
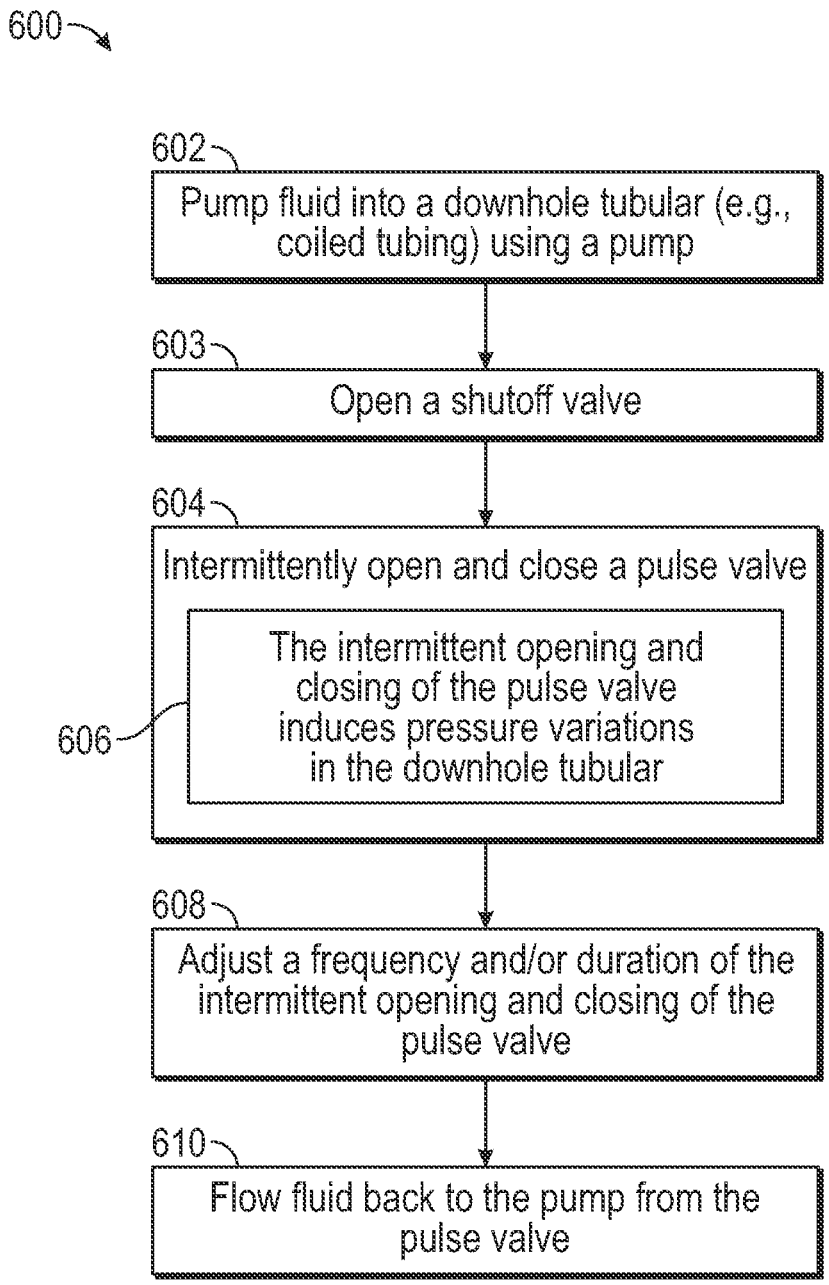
FIG. 6 illustrates a flowchart of a method for vibrating a downhole tubular, according to an embodiment.

FIG. 6 illustrates a flowchart of a method 600 for vibrating a downhole tubular, according to an embodiment. The method 600 may be executed using the pulse valve 100 and/or 500, or another valve. For the sake of convenience, the method 600 is described herein with reference to the pulse valve 100 (integrated into the system 200), as shown in and described above with reference to FIGS. 1-4; however, it will be appreciated that this is merely an example. The method 600 may begin by pumping a fluid into a downhole tubular 206 using a pump 204, as at 602.

When a vibration is desired, the method 600 may include opening a shutoff valve 210 in a pulse line 209 connected to the line 208 between the pump 204 and the downhole tubular 206, as at 603. The method 600 may also include intermittently opening and closing a pulse valve 100 positioned downstream from the shutoff valve 210, as at 604. Because the line 209 taps fluid flow from the line 208 that is downstream from the pump 204 and upstream from the downhole tubular 206, the pulse valve 100 may likewise be considered downstream from the pump 204 and upstream from the downhole tubular 206. Moreover, intermittently opening and closing the pulse valve 100 causes intermittent pressure variations (e.g., pulses or spikes) of the fluid in the downhole tubular, so as to vibrate the downhole tubular, as at 606.

In an embodiment, the method 600 may further include adjusting a frequency and/or duration of the intermittent opening and closing of the pulse valve 100, as at 608. Changing the frequency of the intermittent opening and closing refers to the number of times the valve 100 is opened and closed over a given time period. Changing the duration of the intermittent opening and closing refers to the amount of time the valve 100 remains open or remains closed in a given open/close cycle. Changing the frequency and/or duration may affect the frequency, phase, or other vibratory characteristics of the vibration induced in the downhole tubular 206 via the use of the pulse valve 100.

Changing the frequency and/or duration may be accomplished by changing the speed of rotation applied by the driver 110. For example, the pulse valve 100 may have a rotatable valve element (e.g., the valve shaft 300), which may be rotated by the driver 110. The valve shaft 300 may define one or more angular orientations that open the valve 100 and one or more angular orientations that close the valve 100. For example, the rotatable valve element (e.g., the valve shaft 300) may define one or more openings that, as the valve element rotates, permit fluid flow therethrough, or are blocked form permitting fluid flow therethrough, depending on the angular orientation of the rotatable valve element. Accordingly, changing the speed of the driver 110 changes the frequency and duration of the alignment of the openings in the valve 100.

In another embodiment, the number and/or geometry of the openings may be changed to change the frequency and/or duration of the valve 100 opening and closing. For example, the first and/or second openings 310-314 and/or 322-326 may be elongated or shortened (e.g., by swapping a different valve sleeve 320 and/or valve shaft 300 into the valve 100) to modify the opening/closing duration. Further, additional openings may be formed or one or more of the openings omitted or at least partially blocked, so as to again change the frequency and/or duration of opening/closing the valve 100 in addition to or in lieu of changing the rotational speed of the driver 110.

In some embodiments, the method 600 may further include flowing fluid from an outlet 106 of the pulse valve 100, when the pulse valve 100 is open, back to the pump 204, e.g., via a tank 202 positioned therebetween, as at 610.

Accordingly, the present disclosure provides a pulse valve that is positionable at the surface of the well, which may be adjusted to provide vibrations with desired characteristics and at desired times in a well. Although two examples of rotary valves are discussed above for the pulse valve, it will be appreciated that other types of valves, such as ball check valves, poppet valves, and the like may also be employed.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An apparatus for generating vibration in a downhole tubular, comprising:

a pulse valve that is configured to open and close intermittently, so as to intermittently vary a pressure of a fluid that flows into the downhole tubular and thereby generate the vibration in the downhole tubular, wherein the downhole tubular comprises a coiled tubing, and wherein the vibration temporarily separates a portion of the coiled tubing from a surrounding tubular, thereby reducing friction between the portion of the coiled tubing and the surrounding tubular, which increases a depth to which the coiled tubing is able to extend in a well; and a driver coupled to the pulse valve and configured to open and close the pulse valve, wherein the driver is powered by a source of energy that is not in fluid communication with the downhole tubular.

2. The apparatus of claim 1, wherein the pulse valve is positioned at a top surface of the well, and wherein the downhole tubular is configured to be deployed into the well.

3. The apparatus of claim 1, wherein the pump is in fluid communication with the pulse valve, so as to provide the fluid thereto and into the downhole tubular.

4. The apparatus of claim 3, wherein the pump is configured to provide a generally constant flow of the fluid to the pulse valve.

5. The apparatus of claim 1, wherein the driver comprises an electric motor, and wherein the source of energy comprises a generator, a power grid, or both.

6. An apparatus for generating vibration in a downhole tubular, comprising:

a pulse valve that is configured to open and close intermittently, so as to intermittently vary pressure of a fluid that flows into the downhole tubular and thereby generate vibration in the downhole tubular, wherein the pulse valve comprises:

a housing having an inlet and an outlet;

a valve sleeve positioned in the housing and in communication with the inlet, wherein the valve sleeve comprises a first opening; and a valve shaft positioned in the housing and at least partially in the valve sleeve, wherein the valve shaft is rotatable relative to the valve sleeve, wherein the valve shaft comprises a second opening that is configured to intermittently align with the first opening as the valve shaft is rotated relative to the valve sleeve, and wherein the first opening being aligned with the second opening opens the pulse valve, such that fluid communication between the inlet and outlet is permitted, and the first opening not being aligned with the second opening closes the pulse valve, such that fluid communication between the inlet and the outlet is blocked; and a driver coupled to the pulse valve and configured to open and close the pulse valve, wherein the driver is powered by a source of energy that is not in fluid communication with the downhole tubular.

7. The apparatus of claim 6, wherein the valve shaft is rotated relative to the housing by operation of the driver, and wherein the valve sleeve is configured to remain stationary with respect to the housing.

8. The apparatus of claim 6, wherein valve sleeve comprises a plurality of first openings, including the first opening, that are axially offset from one another and positioned at different angular intervals around the valve sleeve.

9. The apparatus of claim 8, wherein valve shaft comprises a plurality of second openings, including the second opening, that are axially offset from one another and positioned at different angular intervals around the valve shaft, wherein each of the second openings are intermittently aligned with a respective one of the first openings as the valve shaft rotates relative to the valve sleeve.

10. The apparatus of claim 6, wherein the valve sleeve comprises a multiplicity of separate holes that together define the first opening, and wherein the valve shaft comprises a multiplicity of holes that together define the second opening.

11. The apparatus of claim 6, wherein the inlet is axially-oriented and the outlet is radially-oriented, such that the inlet and outlet are oriented perpendicular to one another.

12. The apparatus of claim 6, wherein:

the valve shaft comprises a shoulder; and the pulse valve comprises an axial thrust bearing positioned between the housing and the shoulder, a radial bearing positioned radially between the valve shaft and the valve sleeve, and a shaft seal positioned between the valve shaft and the housing.

13. An apparatus for generating vibration in a downhole tubular, comprising:

a pulse valve that is configured to open and close intermittently, so as to intermittently vary pressure of a fluid that flows into the downhole tubular and thereby generate vibration in the downhole tubular;

a driver coupled to the pulse valve and configured to open and close the pulse valve, wherein the driver is powered by a source of energy that is not in fluid communication with the downhole tubular;

a pump in fluid communication with the downhole tubular; and a shutoff valve in communication with the pump and in communication with the pulse valve, wherein the shutoff valve is configured to open to allow fluid communication from the pump to the pulse valve, and wherein the shutoff valve is configured to close to block fluid communication from the pump to the pulse valve.

14. The apparatus of claim 13, wherein the pulse valve comprises an inlet in communication with the shutoff valve, and an outlet in communication with an inlet of the pump.

15. An apparatus for generating vibration in a downhole tubular, comprising:

a pulse valve that is configured to open and close intermittently, so as to intermittently vary pressure of a fluid that flows into the downhole tubular and thereby generate vibration in the downhole tubular, wherein the pulse valve comprises:

a housing having an inlet and an outlet;

a driver configured to open and close the pulse valve, wherein the driver is powered by a source of energy that is not in fluid communication with the downhole tubular;

a shaft extending into the housing and coupled to the driver, such that the driver is configured to rotate the shaft; and a valve element positioned in the housing and coupled to the shaft, such that the valve element rotates along with the shaft, wherein the valve element defines a through-port that is intermittently aligned with the inlet and the outlet, permitting fluid communication therebetween, and intermittently misaligned with the inlet and the outlet, blocking fluid communication therebetween.

16. A method, comprising:

pumping a fluid into a downhole tubular using a pump;

intermittently opening and closing a pulse valve positioned downstream from the pump and upstream from the downhole tubular using a driver, wherein intermittently opening and closing the pulse valve causes intermittent pressure variations of the fluid in the downhole tubular, so as to vibrate the downhole tubular; and flowing the fluid from an outlet of the pulse valve when the pulse valve is open back to the pump.

17. The method of claim 16, wherein the driver is not in fluid communication with the downhole tubular.

18. The method of claim 16, further comprising adjusting a speed of the driver so as to change a frequency of the intermittent opening and closing of the pulse valve.

19. A method, comprising:

pumping a fluid into a downhole tubular using a pump; and intermittently opening and closing a pulse valve positioned downstream from the pump and upstream from the downhole tubular using a driver, wherein intermittently opening and closing the pulse valve causes intermittent pressure variations of the fluid in the downhole tubular, so as to vibrate the downhole tubular, and wherein intermittently opening and closing the pulse valve comprises rotating a valve element comprising a first opening relative to a valve sleeve having a second opening.

20. A method, comprising:

pumping a fluid into a downhole tubular using a pump; and intermittently opening and closing a pulse valve positioned downstream from the pump and upstream from the downhole tubular using a driver, wherein intermittently opening and closing the pulse valve causes intermittent pressure variations of the fluid in the downhole tubular, so as to vibrate the downhole tubular, wherein intermittently opening and closing the pulse valve comprises rotating a valve element relative to a housing, wherein the valve element comprises a through-bore that is aligned between an inlet of the housing and an outlet of the housing when the pulse valve is open, and wherein the through-bore is not aligned with the inlet and the outlet, such that valve element blocks communication between the inlet and the outlet, when the pulse valve is closed.

* * * * *